United States Patent [19]

Glanemann et al.

[11] 3,970,341

[45] July 20, 1976

[54] VACUUM LIFTING UNIT INCLUDING A SUCTION CUP

[75] Inventors: Rudolf Glanemann; Wolfgang Schlaupitz, both of Greven, Germany

[73] Assignee: Vacu-Lift Machinenbau GmbH, Emsdetten, Germany

[22] Filed: Nov. 27, 1974

[21] Appl. No.: 527,890

[30] Foreign Application Priority Data

Dec. 12, 1973 Germany ..... 2360575

[52] U.S. Cl. ..... 294/64 R

[51] Int. Cl.[2] ..... B66C 1/02

[58] Field of Search ..... 294/64 R, 65, 110 R; 214/650 SG; 248/362, 363; 269/21; 279/3

[56] References Cited

UNITED STATES PATENTS

| | | | |
|---|---|---|---|
| 1,294,103 | 2/1919 | Hitchcock | 294/64 R |
| 3,084,928 | 4/1963 | Opitz | 294/64 R X |
| 3,704,038 | 11/1972 | Glanemann | 294/64 R X |
| 3,759,560 | 9/1973 | Yoda et al. | 294/64 R |

FOREIGN PATENTS OR APPLICATIONS

| | | | |
|---|---|---|---|
| 2,118,293 | 4/1971 | Germany | |
| 6,703,467 | 9/1968 | Netherlands | 294/64 R |
| 1,000,800 | 8/1965 | United Kingdom | 294/64 R |
| 219,144 | 8/1968 | U.S.S.R. | 294/64 R |

*Primary Examiner*—John J. Love
*Assistant Examiner*—Johnny D. Cherry
*Attorney, Agent, or Firm*—Fitch, Even, Tabin & Luedeka

[57] ABSTRACT

A vacuum lift is formed with an upper housing cover shaped portion having a central opening in which travels a vertically movable piston rod which has a piston disk at its lower end adapted to be selectively positioned to open or close an aperture in a suction disk having an encircling gasket. An enlarged evacuated volume is provided within the housing cover by expanding a plurality of diaphragm sheets into a bellows. The lowermost diaphragm sheet is connected directly to the suction disk and the uppermost diaphragm sheet is connected to and lifted by the piston rod to expand the bellows. The piston disk is formed with an air valve which is positioned by an automatic switching device operable with vertical movement of a draw bar positioned within the hollow piston.

1 Claim, 3 Drawing Figures

VACUUM LIFTING UNIT INCLUDING A SUCTION CUP

The present invention relates to a vacuum lifting unit including a suction cup, comprising a cover-shaped upper portion having an opening for receiving a piston rod connected to a piston disc, and a suction disc provided with a contacting gasket, which suction disc includes an aperture adapted to be closed by said piston disc.

A vacuum lifting unit of this type is known from the German patent application No. 2,118,293 laid open to public inspection. In the lifting unit according to the prior art, the suction disc is provided with a funnel-shaped lower or base portion, whereby a sealing diaphragm is secured on the one hand between the flanged connection of upper and lower portions, and on the other hand on the piston disc. The conventional lifting unit has proved its usefulness in the embodiment as proposed in said German patent application No. 2,118,293 laid open to public inspection. However, said lifting unit should be improved in the following respects:

a. The suction disc should be directly used for the attachment of the sealing diaphragm; a base portion of special construction which would increase the cost for the lifting unit, should be avoided;
b. An enlarged evacuated volume should be provided with the same stroke of the piston;
c. The diaphragm sheets or foils should be easy to produce, and during the retraction of the piston, they should not assume such a position that they might "collapse" in the unloaded condition.

These objects are solved in a vacuum lifting unit of the type as outlined above in that a plurality of superposed diaphragm sheets surrounding said piston rod are sealingly interconnected at their peripheries in zigzag fashion, while the uppermost and the lowermost diaphragm sheets are additionally sealingly connected to said piston rod and to said suction disc respectively. Accordingly, the suggested construction consists in that some kind of a bellows is disposed around the piston rod, which bellows comprises diaphragm sheets or foils, superposed to each other in zig-zag fashion, which diaphragm sheets are expanded in accordian-like fashion when the piston moves upwards. During such expansion, an additional volume is opened in which the air is rarefied to substantial degree. An advantage of this embodiment resides in the fact that the sheets may be produced simply as cut-outs or blanks which do not require any bias or special configuration to be vulcanized into them. Replacement is easy, and storekeeping is rendered less expensive. The lowermost diaphragm sheet may be connected directly to the suction disc such that a base portion of a special configuration is omitted.

On principle, any desired number of diaphragm sheets may be place one above the other, whereby such number may be readily increased or decreased. However, it has proved to be of particular advantage to use five circular disc-shaped diaphragm sheets.

In order to join and seal the diaphragm sheets relative to each other and with respect to the components of the lifting unit, circular disc-shaped clamping parts are proposed which are adapted to be bolted one onto the other, onto a piston flange or onto the suction disc and which with their flat faces sealingly press the periphery of the diaphragm sheets against an abutment face.

In order that a particularly effective sealing is produced, it is proposed to make the diaphragm sheets of greater thickness at their peripheries.

Further properties and advantages of the vacuum lifting unit according to the present invention are explained in the following by referring to the drawing, wherein.

Figure 1:
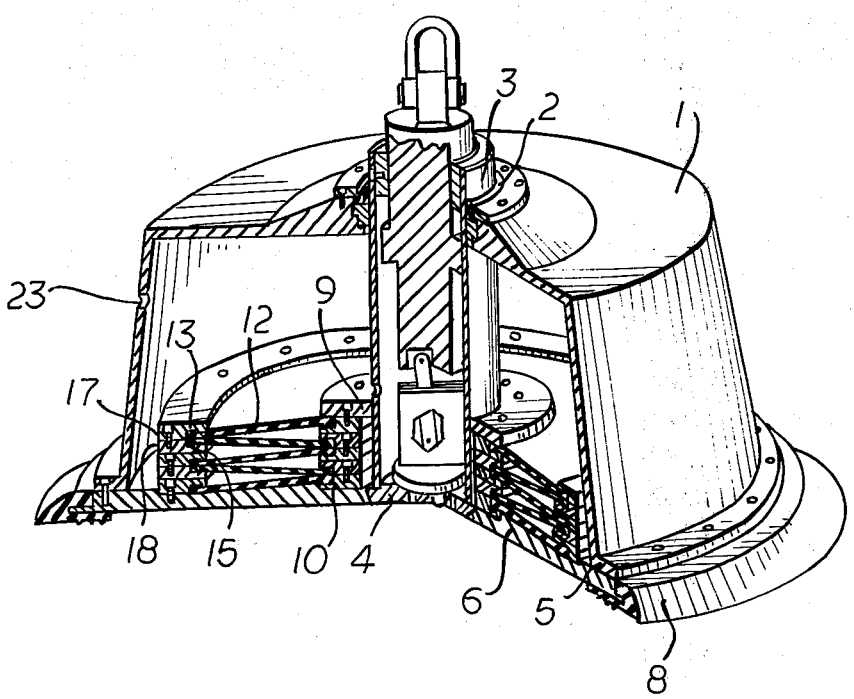
FIG. 1 shows a perspectivic sectional view of a lifting unit.

As illustrated in FIG. 1, the vacuum lifting unit comprises essentially a cover-like upper portion 1 being provided with a central aperture 2 in which a piston rod 3 having a piston disc 4 at its end is adapted to slide up and down. The lower edge of the upper portion 1 is provided with a flange 5 which rests upon a suction disc 6 and which is bolted to the latter.

The suction disc 6 is surrounded by a rubber contacting seal or gasket 8.

Around the cylindrical surface of the piston rod, a rim 9 being welded to said cylindrical surface is positioned above the piston disc 4. The rim 9 has planar, smooth upper and lower faces. When the piston rod 3 is pulled up, the rim with its upper side abuts against the upper portion 1. Opposite from this abutment side, an annular disc-shaped clamping portion 10 is bolted to the rim 9, whereby the thickened or bulged end 11 of a diaphragm sheet 12 is clamped and sealingly retained between portions 9 and 10. The diaphragm sheet 12 likewise has a circular ring shape, and it surrounds the piston rod. The free outer edge 13 of the diaphragm sheet is connected to a corresponding outer edge 15 of a diaphragm sheet 16 therebelow by having bolted thereto a pair of further clamping portions 17, 18 which retain the thickened or bulged ends between them. The construction of the clamping portions 17, 18 corresponds to that of the clamping portion 10, while they are of greater diameter.

Figure 2:
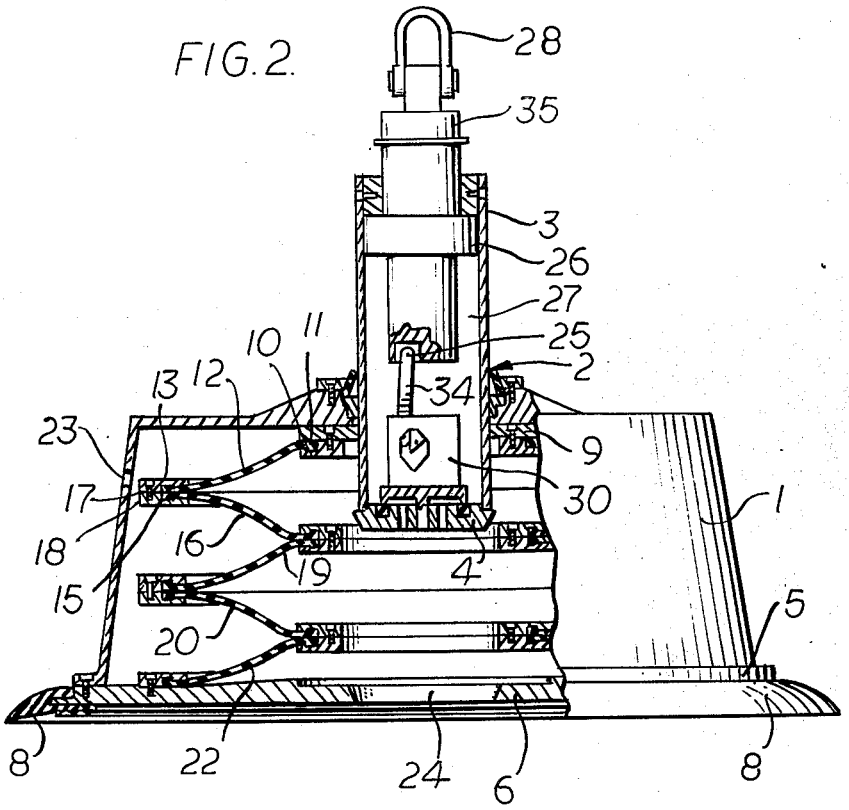
FIG. 2 is a sectional view of the lifting unit according to FIG. 1 with the piston pulled up.

As can be seen from FIG. 2, there are provided three further diaphragm sheets 19, 20, 22 the ends of which are likewise interconnected by means of clamping portions, such that a zigzag-shaped assembly of the five diaphragm sheets provided is formed.

The lowermost diaphragm sheet 22 has its free end connected directly to the suction disc 6. As can be seen particularly from FIG. 2, the arrangement chosen provides the possibility of expanding the zigzag-shaped assembly of the diaphragm sheets in the shape of a bellows by pulling out the piston rod 3. By means of a corresponding stiffness of the diaphragm sheets, it is thereby prevented that the exterior air pressure compresses the bellows to any appreciable degree. In order that air may exit from the upper portion when the bellows is expanded, an outlet opening 23 is provided.

At the bottom of the suction disc 6, a conically shaped aperture 24 can be seen which aperture the piston disc 4 seats in its closing movement.

Figure 3:
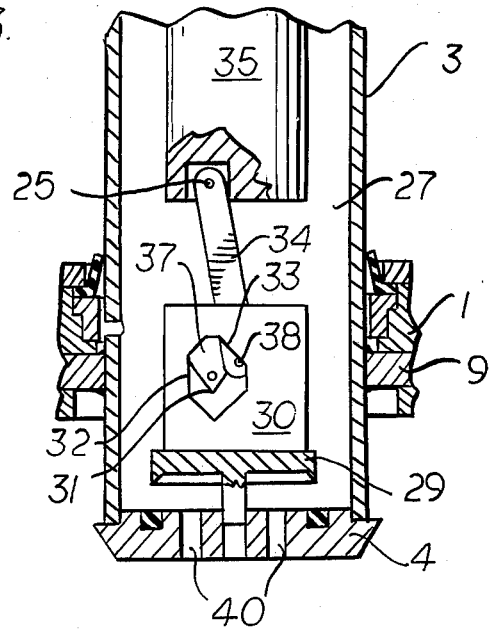
FIG. 3 shows a detail of FIG. 2 in a different position of the closure valve.

FIG. 3 illustrates an automatic switching device being particularly useful for the present unit and enabling the unit to be switched over during each contacting or placement operation. The piston rod 3 of the unit is formed as a hollow cylinder in which a draw bar 35 is guided for upward and downward movement. The draw bar has a handle or an eye 28 at its upper end at which it may be grasped. The lower end of the draw bar 35 extends into the hollow space 27 of the piston rod 3. The draw bar is provided with a flange 26 which forms the stop for the draw bar during its upward movement.

Beneath the flange 26, the draw bar is provided with a hinge or pivot 25 from which a strut 34 is suspended so as to be swingable. The strut carries a bolt at its lower end which bolt is securely mounted in a bore of the strut and which protrudes on both sides from such bore, such that a pair of pins or lugs 38 are formed.

The strut is movably suspended between a guide plate 30 and a guide or deflector element 37. The guide plate has a polygonal cutout 31 into which a pin 38 extends such that its range of movement is limited by guide faces 32 and 33. The deflector element 37 has an approximately triangular configuration, and it is rotatably mounted at a second surface (which can be gathered from FIG. 1). Rotary or pivotal movement of said deflector element 37 is limited by a stop. Thus, the deflector element may assume two positions, namely a position in which the left hand upper corner is held to the stop, and another position in which the right hand corner is arrested.

As the protruding pin 38 at the other side abuts against the guide faces of the deflector element, two fixed positions are defined in which the pin is arrested between the surfaces and fixed against upward movement. As can be seen from FIGS. 2 and 3, these two positions are at different levels such that the guide plate 30 has a lower position and an upper position (FIG. 3). That is, stated differently, the effective length of the strut 34 is so short when the strut 34 is bent into the position shown in FIG. 3 with the pin 38 located to the right between the adjacent guide surfaces of the deflector element 37 and the polygonal opening that the last portion of the upward movement of the draw bar 35 lifts the valve element to position shown in FIG. 3 before the flange 26 on the draw bar hits the plug cylinder closing the top end of the hollow piston 2. On the other hand, when the strut 34 is substantially vertical as shown in FIG. 2 with the pin 38 to the left, the effective length of the strut is sufficiently longer that the flange 26 of the draw bar 35 is able to abut the cylindrical plug at the top of the hollow piston rod 3 without pulling the guide plate 30 upwardly to expose bores 40 in the piston disk 4.

A valve head or poppet 29 is connected to the guide plate. This poppet covers bores 40 provided in the piston disc proper, which bores open towards the aperture 24. As is evident from FIGS. 2 and 3, the bores 40 are closed when the valve element 29 is lowered, and opened when said element is raised.

The switching mechanism operates as follows:

The lifting unit is placed onto a smooth surface, e.g. a sheet metal plate. In this condition, the piston rod is pushed inwards, and the pin is in its lowermost position, as illustrated in FIG. 1. When a pulling force is exerted upon the piston rod, the pin slides into the lower position with the valve element 29 being in its closing position. The piston rod is then pulled up further so as to slide upwards within the suction cup. Hereby, a vacuum is produced underneath the bores or openings 40, which vacuum progresses through the bellows formed by the diaphragm sheets. The load to be lifted is raised, and, as best seen in FIG. 2, the strut 34 will be positioned with the pin 38 on the left side of the deflector element 37 and the pin 38 will move higher without having lifted the guide plate 30 and the valve head 29. When the load is laid down, the piston rod descends by its own weight and under the air pressure. The pin 38 slides to the lowermost point of the guide face 33, whereby the deflector element is pivoted into the position of FIG. 3. When drawing the draw bar, the pin slides into the uppermost position on the deflector element. Hereby, the valve element 29 may be withdrawn from the bores 40 such that air may enter the bellows through the hollow piston rod and the bores or openings 40. In this way, the load is released from the contacting gasket.

When the valve element 29 is to be returned into its closing position, the piston rod is again lowered into the hollow space by its own weight, whereby the deflector element is pivoted to the position shown in FIG. 1. Then, the pin of the strut is moved to the other side of the deflector element when the piston is pulled up. Thereupon, the pin is in its lower position again. The valve element seals the bores or openings 40. In this way, a vacuum can be generated again within the volume defined by the diaphragm sheets while the piston is pulled up.

What we claim is:

1. A vacuum lifting unit comprising a frame including an upper cover housing portion having a center opening, a hollow piston rod slidable in said center opening having its upper end connected to said frame, a piston disc connected to the lower end of said hollow piston rod, a suction disc connected to said housing cover portion and having a central aperture adapted to be selectively covered by said piston disc when the latter is lowered into its lowermost position, an encircling contacting gasket on said suction disc, a series of annular diaphragm sheets disposed in said housing cover portion having hollow central portions through which extends said piston rod, means connecting the lower one of said diaphragm sheets to said suction disc, means connecting the upper one of said diaphragm sheets to said hollow piston for movement therewith, said diaphragm sheets being extendable to form a bellows with lifting of said piston rod, said diaphragm sheets being in fluid communication with said suction disk through said aperture and providing an increased volume of rarified atmosphere with upward travel of said hollow piston rod and expansion of said bellows, said piston disc having hollow bores therein for fluid communication between the interior of said hollow piston rod and said suction disc, a selectively operable valve means within said hollow piston for closing said bores in said piston disc, a draw bar slidably mounted within said hollow piston, said valve switching means comprising a vertically movable valve element positioned within said hollow piston for selectively opening and closing said bore holes in said piston disc, an upstanding guide plate fixedly attached to said valve element, said guide plate having a polygonal-shaped opening with a pair of guide surfaces thereon converging in the direction of the axis of the piston rod, a strut suspended at its upper end on said draw bar, a pin means formed on the lower end of said strut and positionable in said polygonal opening, a deflector element pivotably mounted on said guide plate for shifting between two positions and having a pair of guide surfaces at an angle relative to each other, said pin means slidable to positions to engage said guide surfaces of said deflector element and said guide surfaces defining said polygonal opening, upward and downward movement of said strut and said pin means positioning said valve element to leave open said bore holes with said draw bar raised and positioning said valve element to close said bore holes when said draw bar is lowered.

* * * * *